United States Patent [19]

Michaels et al.

[11] Patent Number: 4,762,504

[45] Date of Patent: Aug. 9, 1988

[54] CONNECTOR COUPLING LOCK

[75] Inventors: Leonard H. Michaels, Warrenville; Robert A. Miller, Woodridge, both of Ill.

[73] Assignee: Molex Incorporated, Lisle, Ill.

[21] Appl. No.: 84,645

[22] Filed: Aug. 11, 1987

Related U.S. Application Data

[62] Division of Ser. No. 830,796, Feb. 19, 1986, Pat. No. 4,707,047.

[51] Int. Cl.[4] ..... H01R 13/627

[52] U.S. Cl. ..... 439/345; 439/350

[58] Field of Search ..... 439/296, 345, 347, 349, 439/350

[56] References Cited

U.S. PATENT DOCUMENTS 4,070,080 1/1978 Eshleman et al. ..... 439/345

4,284,313 8/1981 Anhalt ..... 439/350

4,422,704 12/1983 Williams ..... 439/349

4,453,793 6/1984 Panek et al. ..... 439/345

4,525,016 6/1985 Williams ..... 439/296

*Primary Examiner*—J. Patrick Mcquade

*Attorney, Agent, or Firm*—John W. Cornell; Louis A. Hecht

[57] ABSTRACT

An environmentally sealed connector assembly includes interfitting manually telescoping separable plug and receptacle connectors. Each connector includes an outer metallic shell, with the plug connector telescopically interfitting the receptacle shell. A manually compressible resilient split ring is captively mounted on the receptacle shell, and has inwardly extending tab portions communicating with the plug shell when the two shells are intermated. The plug shell includes a tab-receiving channel which locks with the split ring upon telescopic mating of the two connector parts.

4 Claims, 2 Drawing Sheets

CONNECTOR COUPLING LOCK

This is a division of application Ser. No. 830,796 filed Feb. 19, 1986, now U.S. Pat. No. 4,707,047.

BACKGROUND OF THE INVENTION

1. Field of the Invention

The present invention pertains to environmentally sealed electrical connectors of the plug and receptacle type.

2. Description of the Prior Art

The present invention pertains to ruggedized mating electrical connectors, each of which are enclosed in an outer metallic shell. Specifically, each connector receives a dielectric insert in which a plurality of electrical terminals are mounted. Such electrical connectors are typically required in the aircraft ground support and automotive industries, as well as in machinery and outdoor, unprotected environments.

Electrical connectors of this type require a mechanical connection or coupling between mated connector pairs. One popular coupling technique uses a threaded engagement between connector pairs. However, such threaded engagements oftentimes become loose and may ultimately become disconnected when subjected to stresses such as shocks and vibrations. Where reliability is an important factor, as in electrical connectors, loosening or disengagement is a serious problem. Even partial loosening of the connectors can be troublesome, in that connector fretting can occur where mated electrical terminals are free to vibrate, causing degradation of their mating surfaces.

Further, threaded couplings are unattractive in many applications, since an operator is required to perform repetitive manipulations with each coupling, such as repeated grasping and partial turning of a threaded connector part. From a time-motion standpoint, physically unrelated manipulations such as pushing connector pairs together for mating, and thereafter rotating threaded coupling parts is inefficient. However, it is desired that distinctly different operator manipulations be required for connector mating and unmating, to prevent the risk of accidental unmating.

Accordingly, it is an object of the present to provide a coupling system for mating plug and receptacle connector pairs that provides a reliable coupling between connectors without loosening under the effects of shock or vibration.

It is another object of the present invention to provide a coupling arrangement of the above-described type which provides coupling with a single motion of an operator, and which is uncoupled for unmating with a different motion.

SUMMARY OF THE INVENTION

These and other objects are provided in an environmentally sealed connector assembly including interfitting manually telescoping separable plug and receptacle connectors. The plug connector includes an outer rigid shell, a first dielectric support member mounted within the shell, and at least one electrical terminal mounted in the first support member. The receptacle connector includes an outer rigid shell dimensioned to telescopically receive said plug shell, a second dielectric support member mounted within the shell, at least one electrical terminal mounted in the second support member adapted to mate with the plug terminal, and a coupling lock including first and second interengaging portions associated with said plug and receptacle connectors, respectively, for selective locking and unlocking thereof during connector mating and unmating. The improvement in said coupling lock comprises a manually compressible resilient split ring captively mounted on the outside of the receptacle shell, having first and second spaced-apart opposed ends resiliently moveable toward and away from each other as said ring is compressed and released, further having at each free end, inwardly extending tabs with camming surfaces. A tab-receiving channel is formed in said plug shell and extends in the direction of plug insertion, said channel having opposed edges for engaging said camming surfaces, a first entrance portion, a second portion of reduced width for drawing said tabs together during plug insertion so as to compress said ring with a stored bias force, an adjacent enlarged third portion allowing expansion of said tabs under said bias force, and shoulder means forming said third portion for engaging said tabs to prevent withdrawal thereof from said channel; whereby said plug and receptacle connectors are locked together upon telescopic mating, and are unlocked for unmating upon manual compression of said ring sufficient to bring said tabs out of engagement with said shoulder means.

BRIEF DESCRIPTION OF THE DRAWING

In the drawings, wherein like elements are referenced alike.

FIGS. *6a–6c* show a sequence of coupling and uncoupling operations with the connector of the present invention;

FIGS. *7a–7c* are elevated sectional views of the sequence taken along view lines *7a–7a, 7b–7b* and *7c–7c* in FIG. *6a,* FIG. *6b* and FIG. *6c,* respectively.

DETAILED DESCRIPTION OF THE PREFERRED EMBODIMENT

Figure 1:
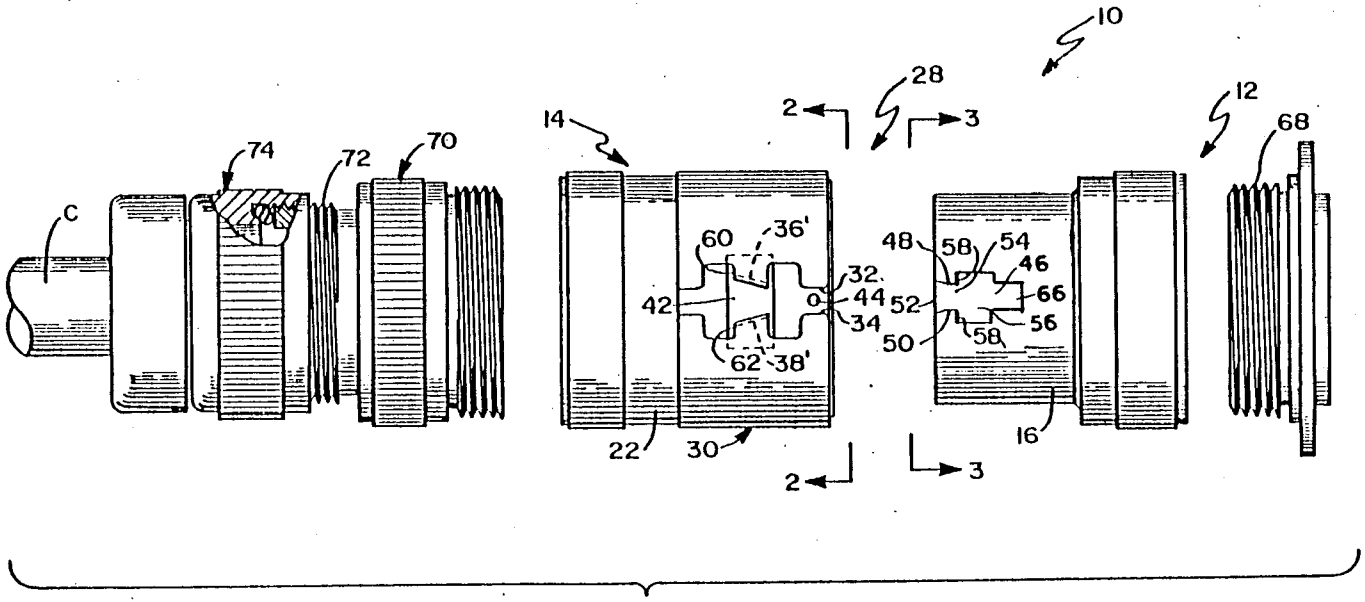
FIG. 1 is an exploded view of a connector assembly according to the present invention.
Figure 2:
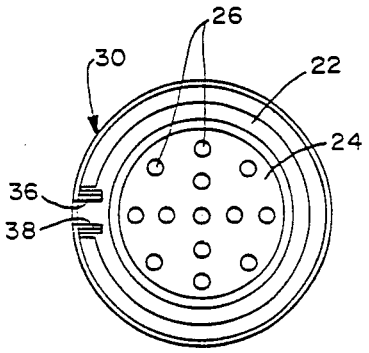
FIG. 2 is an end view of the receptacle portion of the connector taken along view line 2—2 in of FIG. 1.
Figure 3:
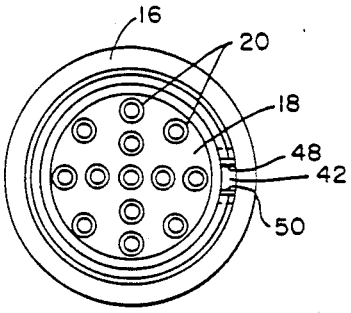
FIG. 3 is an end view of the plug portion of the connector taken along view line 3—3 in FIG. 1.

Referring now to the drawings, and especially to FIGS. 1–3, an environmentally sealed connector assemby is generally indicated at 10. Assembly 10 includes interfitting manually telescoping separable plug and receptacle connectors indicated generally at 12 and 14, respectively. Plug connector 12 has an outer metallic shell 16 a dielectric housing 18 mounted within the shell, and a plurality of female sleeve-type electrical terminals 20 mounted within the housing.

Receptacle connector 14 has an outer metallic shell 22 dimensioned to telescopically receive plug shell 16. A dielectric housing 24 is mounted within the shell, and a plurality of pin-like mole electrical terminals 26 adapted to mate with plug terminals 20, are mounted within housing 24. While shells 16,22 are preferably of metal, other rigid materials such as high strength plastic may be used.

Figure 4:
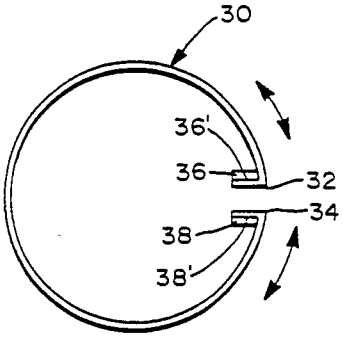
FIGS. 4 and 5 illustrate the coupling ring of the connector of FIGS. 1 and 2.
Figure 5:
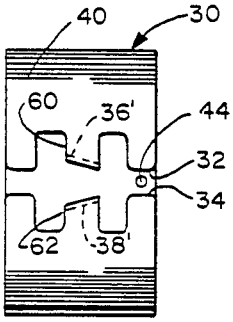

According to the present invention, plug and receptacle connectors 12, 14 are provided with a coupling lock which provides selective locking and unlocking of the connector members during mating and unmating. Referring additionally to FIGS. 4 and 5, the coupling lock includes a first interengaging portion comprising a manually compressible resilient split ring indicated generally at 30 which is captively mounted on the outside of receptacle shell 22. Split ring 30 has first and second spaced-apart opposed free ends 32, 34 which are resiliently moveable toward and away from each other as ring 30 is compressed and released. Free ends 32, 34 have radially inwardly extending tabs 36, 38 each with an external camming surface 36', 38' respectively. Split ring 30 is conveniently comprised of spring-like resilient material such as spring-hardened stainless steel. Stainless steel is selected for the preferred embodiment because it provides high strength and corrosion protection. Copper alloy and plastics are examples of alternative materials.

Receptacle connector 14 is conveniently fabricated by providing a slot 42 in shell 22, for receiving tabs 36, 38. When so received, tabs 36, 38 are held captive in outer shell 22. Immediately adjacent the forwardmost portion of outer receptacle shell 22, is a radially inwardly directed dimple 44 which provides rotational keying or polarizing when the connectors are mated together.

Figure 6:
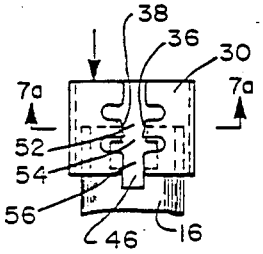
Figure 6:
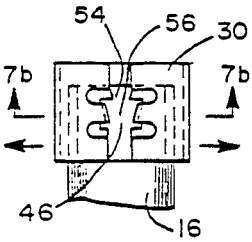
Figure 6:
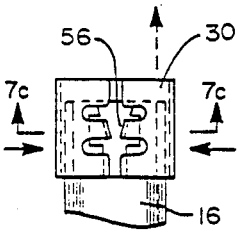
Figure 7:
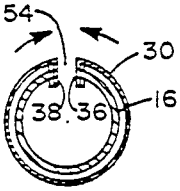
Figure 7:
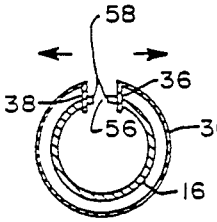
Figure 7:
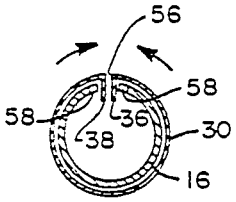

Referring now to FIGS. 1, 6 and 7, plug shell 22 has formed therein a tab receiving channel 46 which is elongated to extend generally in the direction of plug insertion, along the axis of the completed connector assembly of FIG. 1. Channel 46 has opposed edges 48, 50 for engaging camming surfaces 36', 38' during telescoping connector mating. Channel 46 includes a first entrance portion 52, a second portion 54 of reduced width for drawing tabs 36, 38 together during telescoping plug insertion, so as to compress ring 30 with a stored bias force. Further, channel 46 includes an enlarged third portion 56 allowing expansion of tabs 36, 38 under the stored bias force. A shoulder 58 forms part of enlarged portion 56 which engages the rearward edges 60, 62 of tabs 36, 38 upon completed mating of the connector parts, to prevent withdrawal of the tabs from channel 46.

During mating of connector parts 12, 14, a single axially directed telescoping motion is all that is required to both mate the electrical terminals and lock the connector parts together. As plug and receptacle connectors 12, 14 are brought together, the camming surfaces 36', 38' contact the entrance portion 52 of plug sidewalls 48, 50. Owing to the tapered or angle orientation of tabs 36, 38 further engagement of camming surfaces 36', 38' with channel sidewalls 48, 50 causes a circumferentially inwardly directed compression of tabs 36, 38 drawing the free ends 32, 34 of the split ring together so as to close the gap therebetween. The tapered diverging camming surfaces 36', 38' provide simple reliable connector mating, particularly when the leading portions of channel sidewalls 48, 50 (those at entrance portion 52) engage camming surfaces 36', 38' along their midsection to provide a smooth initial sliding contact between mating connectors. Thereafter, upon continued telescoping mating, tabs 36, 38 are continually drawn together as camming surfaces 36', 38' engage the reduced portion 54 of channel sidewalls 48, 50. This action continues to store a spring energy of predetermined, controlled magnitude in ring 30, the energy being released upon entrance of tabs 36, 38 in enlarged channel portion 56. At this point in the mating operation, tabs 36, 38 spring outwardly, with their rear edges 60, 62 overlying shoulders 58. Thereafter, any reverse motion tending to pull the connectors 12, 14 apart, causes engagement between shoulders 58 and tab end surfaces 60, 62, effectively preventing unintentional unmating. An additional recess 66 formed as an extension of channel 46 receives dimple 44 of the receptacle connector 14. Engagement between dimple 44 and recess 66 provides a rotational aligning or polarization between connector parts 12, 14.

FIG. 1 shows one example of a completed connector assembly comprising connector parts 12, 14. Plug connector 12, for example, is shown mated to a threaded flange mounting 68 which is intended for bolted securement to an equipment item. The receptacle connector 14 is shown connected to a coupling element generally indicated at 70, having a rearward external threaded portion 72. Coupling 70 is in turn threadingly connected to a strain relief cap generally indicated at 74 which engages a cable C having conductors electrically connected to receptacle terminals 26.

I claim:

1. An environmentally sealed connector assembly including interfitting manually telescoping separable plug and receptacle connectors, the plug connector having an outer rigid shell, a first dielectric support member mounted within the shell, and at least one electrical terminal mounted in the first support member, the receptacle connector having an outer rigid shell dimensioned to telescopically receive said plug shell, a second dielectric support member mounted within the receptacle shell, and at least one electrical terminal mounted in the second support member adapted to mate with the plug terminal, and a coupling lock including first and second interengaging portions associated with said plug and receptacle connectors, respectively, for selective locking and unlocking thereof during connector mating and unmating, the improvement in said coupling lock, comprising:

a manually compressible resilient split ring captively mounted on the outside of said receptacle shell, having first and second spaced-apart opposed ends resiliently moveable toward and away from each other as said ring is compressed and released, further having at each free end, inwardly extending tabs with camming surfaces;

a tab-receiving channel formed in said plug shell and extending in the direction of plug insertion, said channel having opposed edges for engaging said camming surfaces, a first entrance portion, a second portion of reduced width for drawing said tabs together during plug insertion so as to compress said ring with a stored bias force, an adjacent enlarged third portion allowing expansion of said tabs under said bias force, and shoulder means forming said third portion for engaging said tabs to prevent withdrawal thereof from said channel;

whereby said plug and receptacle connectors are locked together upon telescopic mating, and are unlocked for unmating upon manual compression of said ring sufficient bring said tabs out of engagement with said shoulder means.

2. The connector assembly of claim 1 wherein wherein said second channel portion is tapered to progressively draw said tabs together during plug insertion.

3. The assembly of claim 1 wherein said outer plug shell has a tab-receiving slot formed therein for receiving and holding captive said tabs as said ring is mounted about said plug shell, whereby said ring is captively mounted on said receptacle shell.

4. The assembly of claim 1 wherein said outer receptacle shell includes a radially inwardly extending dimple formed adjacent its leading end, and said tab-receiving channel is extended to receive said dimple as said plug and receceptacle connectors are mated.

* * * * *